United States Patent [19]

Frey et al.

[11] 4,315,416

[45] Feb. 16, 1982

[54] BATH CONTAINER FOR A REFRIGERATION EQUIPMENT

[76] Inventors: Walter Frey, Holgenburg 17; Rolf Kaiser, Dulkweg 21, both of 73 Esslingen, Fed. Rep. of Germany

[21] Appl. No.: 188,279

[22] Filed: Sep. 18, 1980

[30] Foreign Application Priority Data

Sep. 27, 1979 [DE] Fed. Rep. of Germany ..... 2939076

[51] Int. Cl.[3] ..... F25D 11/04

[52] U.S. Cl. ..... 62/438; 62/525; 165/30

[58] Field of Search ..... 62/64, 430, 525, 438; 165/30

[56] References Cited

U.S. PATENT DOCUMENTS 2,049,708 8/1936 Lieb ..... 62/439
3,623,331 11/1971 Buyens ..... 62/63
3,734,169 5/1973 Palk ..... 165/30

FOREIGN PATENT DOCUMENTS 765279 6/1934 France ..... 62/95

*Primary Examiner*—Ronald C. Capossela
*Attorney, Agent, or Firm*—Michael J. Striker

[57] ABSTRACT

A bath container for cooling a liquid contained therein for use in refrigeration equipment includes a jacket bounding a space for the liquid which comprises a side wall and a bottom wall. The side wall of the jacket is formed of two individual walls spaced from one another to form a hollow chamber therebetween which chamber is connected to a refrigerant feeding member and to a refrigerant discharging member whereby the jacket forming the hollow chamber and adapted to pass the refrigerant therethrough functions as an evaporator. A surface heating element including a heating wire inserted into a relatively thick insulating packing is mounted on the surface of the bottom side to supply heat to the working liquid contained in the bath container.

11 Claims, 3 Drawing Figures

BATH CONTAINER FOR A REFRIGERATION EQUIPMENT

BACKGROUND OF THE INVENTION

The present invention relates to refrigeration systems, and more particularly to a bath container for cooling a working liquid contained therein, which container is a part of the refrigeration system.

A bath container known in the art normally includes a housing made of a stainless steel and produced by a deep drawing and an evaporator in the form of a tubular conduit coil which is located within or outside the housing and rigidly connected thereto. The mounting of the evaporators outside the bath is particularly disadvantageous since the stainless steel is a low heat-conductor and since such installation reduces the cool conducting surface available within the container for cooling the working fluid for any given loads of the refrigeration systems. When the evaporator is installed within the interior of the container, this leads to a double cool conducting surface for the same cooling loads. The disadvantage of the internal installation of the evaporators also recides in space losses which reduce the mounting abilities of the bath containers. Furthermore, the problem encounters where there is the necessity to clean the container or to change the working liquid therein.

SUMMARY OF THE INVENTION

It is therefore an object of the invention to provide a bath container for cooling a liquid contained therein which avoids by simple means the aforementioned shortcomings encountered in the prior art.

Another object of the invention is to provide an improved bath container which is a part of a refrigeration system.

Still another object of the invention is to provide an improved bath container for cooling a liquid contained therein in which the parts are particularly compact.

Yet another object of the invention is to provide a construction of the bath container of maximum simplicity, efficiency and ease of assembly and operation. These and other objects of the invention are attained by a bath container for cooling a liquid contained therein particularly for use in refrigeration equipment, comprising a housing having a jacket bounding a chamber for the liquid and having an upper opening for receiving said liquid, at least a portion of said jacket being formed with a double wall arranged to form an enclosed hollow chamber therein, said portion adapted to receive a refrigerant, to pass the same through said portion and to discharge it, whereby said jacket functions as an evaporator.

In such construction, a bath container for a refrigeration system is provided where the optimal cool conducting surface is available for cooling the liquid contained in the bath container, which container may be easily obtained without reducing of the container's volume and disturbing the structural parts of the container arranged in the interior thereof.

By provision of a double-walled bath container with an evaporator formed in the housing wall of the container the most possible heat exchange between the refrigerant and the liquid to be cooled may be obtained. The considerably higher cool conducting for cooling of the working liquid may be achieved in the present device comparatively to those known in the art which have evaporator's mounted outside of the bath container if the same cooling loads are required in both cases. Comparatively to the arrangements having internal mounting of the evaporator, the present device sufficiently increases the container's volume. It should be noted that the arrangements having evaporators inserted into the containers and including various structural elements inside the container additionally have the problem concerning with cleaning the interior of the container which problem is efficiently overcome in the bath container, of the invention. The bath container of the invention provides the sufficient temperature distribution with fine temperature constancy within the working fluid due to sufficient surface heat exchange.

In the cooling container according to the invention, so-called flooding evaporator may be formed because the substantially large refrigerant conducting area is available in the present container structure. In such flooding containers refrigerant is accumulated within the evaporator which can not be achieved in the known bath containers with evaporators of tubular types; these bath containers relate to the type of the so-called drying evaporator which is immediately connected to the refrigerant vapor and used to obtain sufficiently low temperatures of the working fluid. The bath container of the invention substantially reduces the manufacturing costs of the equipment by provision of the sufficiently large heat exchange area and refrigerant accumulation in the refrigerant circuit which functions as an evaporator.

The jacket of the container may include a bottom wall and a peripheral side wall, said portion of said jacket being formed by said side wall.

The jacket may be formed of a stainless steel.

The container further comprises a refrigerant feeding member for injecting the refrigerant into said hollow chamber and a refrigerant discharging member for withdrawing the refrigerant from the hollow chamber, the feeding member and the discharging member being spaced from one another at the most possible distance along the height of the jacket.

The feeding member may be formed as a capillary tube.

The large volume of the evaporation zone in the container according to the invention facilitates the injection of the refrigerant through the capillary tube thus to further enlarge the temperature rate. Therefore the bath container of the invention permits the avoidance of the well known expansion valves normally utilized in the tubular type evaporators. Because of the provision of the substantially large heat exchange area refrigerant moves within the evaporator with a relatively low velocity so that the evaporator functions as a natural fluid separator. This is an essential advantage of the present device. The refrigerant is completely evaporated in the internal cooling conduits of the evaporator and cools the working fluid contained in the container. The efficiency of the bath container according to the invention is therefore considerably increased.

The possibility to avoid the utilization of the expansion valves substantially reduces the manufacturing costs of the refrigeration equipment. The large amounts of bolting connections which are required and must be hermetically sealed in connection points between the expansion valves and the tubular conduits in the refrigeration systems of the conventional types are also avoided in the present arrangement.

This permits one to increase the longetivity of the bath containers utilized in the refrigeration systems.

The installation of the refrigerant feeding member and refrigerant discharging member at the most possible distance from one another along the height of the container also increases the efficiency of the evaporating process because, on the one hand it is ensured that only dried refrigerant vapor is removed from the refrigerant discharging opening and, on the other hand the whole hollow space between the individual walls of the doubled housing wall is used as an evaporator.

The hollow chamber formed between the two individual walls of the housing wall may be subdivided into a plurality of chambers communicated with one another.

The doubled wall of the container may be formed by two individual walls, said individual walls being connected to each other by means of connecting spots regularly spaced from each other to thereby form said plurality of chambers.

Such a construction is also advantageous since it increases the stability and rigidity of the housing wall without affecting the available surface heat exchange area formed by said hollow chamber.

The individual walls of the doubled housing wall may be rigidly connected to each other at said spots by means of spot welding.

These individual walls may be rigidly connected to each other at said spots by means of roller seam welding.

The structure of the bath container with the plurality of relatively small chambers permits uniform surface heat removal from the working fluid filled the container. This structure also provides the uniform temperature distribution over the entire volume of the working fluid. The manufacturing of the doubled wall of the container is at the same time very easy.

The double-walled portion of the container may extend through the whole periphery of said side wall.

The side wall of the container may be rigidly attached to the bottom wall thereof by means of welding.

The side wall may have a substantially rectangular cross-section and include four space boundary wall elements constituting said hollow chamber.

The refrigerant feeding member and the refrigerant discharging member may extend normal to one of the wall elements and connected to two opposite ends thereof, respectively.

The side wall of the container may be formed as a one-piece item.

The wall elements may be rigidly connected to each other to form the side wall. They may be connected by means of welding.

By forming the container of four relatively simple wall elements or by forming the bath container as a one-piece member a flat surface construction may be easily fabricated to form a container of any desirable shape.

By welding the end surfaces of one-piece side wall and by welding the side wall to the bottom wall the jacket of the container may be easily produced. This provides an easily assembled and thus particularly inexpensive bath container for cooling the working fluid contained therein.

The container's housing may have a box-type shape.

The container may further include a surface-heating element mounted on said bottom wall.

This heating element may include a heating wire of substantially small cross-section.

This heating element may be isolated from said bottom wall.

This heating element may be enclosed with a relatively thick packing.

This packing may include an insulating mat of insulating material, said heating wire being embedded into this mat.

This mat may be rigidly connected to the bottom wall of the housing.

The mat may be made of silicone rubber.

The mat may be connected to the bottom wall of the housing by means of vulcanization.

By provision of the surface heating element mounted on the bottom wall of the housing jacket, a temperature constancy through the entire area of heat exchange and within large time period is obtained in the present bath container which is also advantageous. The heating element mounted on the outer surface of the jacket provides the sufficient surface heat transfer with fine temperature distribution and relatively small inercia in the temperature control process. The local overheating of the working fluid is avoided in the bath container of the invention. Because of the external installation of the heating element the danger of burning or explosion of the equipment during the switching operation is totally prevented. Any electric break-downs within the working fluid are therefore avoided. A danger of accidents which are possible in the conventional equipment having heating coils installed into the working fluid for heating thereof is also completely avoided in the present arrangement. The possible overheating of the upper level of the working fluid due to the internal installation of the heating coils therein which may result in inflaming of the working fluid is also completely prevented in the container according to the invention.

By provision of the surface heating element mounted on the bottom wall of the housing jacket, low process temperatures may be obtained in the boundary layer of the working fluid contacting the housing wall. Instead of heating loads from 20 w ($cm^2$(83,7 joules/s'$cm^2$) which are usually required in the known heating coil installations, the loads in the range of 2–3 w/$cm^2$ (8,37–12,56 joules/s'$cm^2$) are required in the equipment suggested herein.

The bath container proposed herein provides for the optimal temperature control for the refrigeration systems of the foregoing type. It also provides the best possible temperature distribution and the highest temperature constancy in the heat exchange process occurred in the bath container. Additionally, since the heat supply and heat removal are provided in the present device outside from the working fluid the temperature sensors may be also installed outside of the working fluid which permits the avoidance of losses in the thermal recycling control circuit. The container according to the invention does not require additional stirrers which are usually provided in the conventional equipment. This container does not have any additional structural elements within the interior thereof such as a heating element, evaporator tubes or temperature sensors. All the above-mentioned facts permit one to substantially facilitate cleaning of the bath container and change the working fluid in the container when it is desired.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
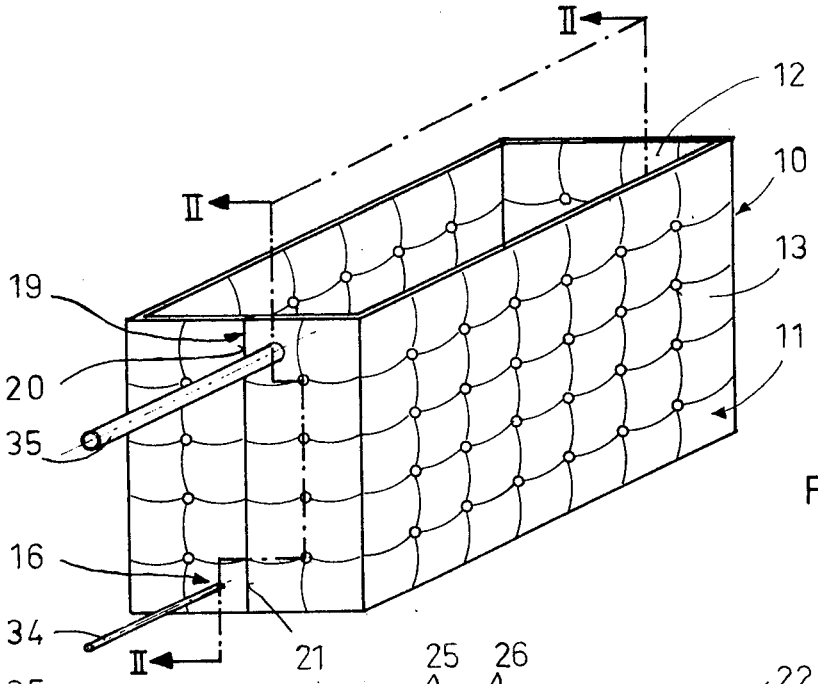
FIG. 1 is a perspective view of a bath container for a refrigeration system according to the invention.

A bath container for cooling a liquid to be filled thereinto is designated as 10 and is particularly used in refrigeration systems where cooling temperatures of the liquid in the container are maintained within the large time range. The bath container has a box-like shape and includes a housing wall or jacket 11 made of a stainless steel. The container has an upper opening 12 through which a working liquid is filled into a chamber formed within the housing wall 11 or discharged therefrom. A working process or heat exchange occurs in the working liquid contained in the bath container during the cooling operation.

The housing wall 11 includes a side wall 13 and a bottom wall 14 rigidly connected thereto.

The side wall 13 may be formed as a one-piece element or may include four rectangular wall elements 19 rigidly connected to each other by any conventional means, for example by welding.

The bottom wall 14 may also be made integrally with the side wall 13 or welded thereto.

The housing wall 11 or at least a portion thereof which is illustrated in this embodiment by the side wall 13 is formed with a double wall having two individual walls 22 and 23 spaced from one another to provide an enclosed hollow space or chamber 5 therebetween so that the jacket 11 constitutes a refrigeration evaporator denoted as 16 in the drawing. The evaporator is connected in a closed refrigeration circuit of a refrigeration system (not shown herein) in a conventional manner. A refrigerant feeding capillary tube 34 with an inlet opening 17 is connected to one of the wall elements 19 so that this tube communicates with the hollow chamber 15. A refrigerant discharging tube 35 with an outlet opening 18 is mounted on the same wall element 19 also in communication with the hollow space 15 between the walls 22 and 23. The tubes 34 and 35 are spaced from each other at the most possible distance along the height of the wall 19 so that the opening 17 is provided at the bottom end of the wall 19 whereas the opening 18 is formed in the vicinity of the upper opening 12 of the jacket 11. The tube 35 is a tubular conduit outwardly extending from the jacket 11.

As was mentioned above, in the preferred embodiment the double-walled portion of the container with the hollow chamber 15 is constituted by the side wall 13, which hollow chamber extends through the entire periphery of the side wall. The upper opening 12 extends substantially normal to the space boundary wall elements 19. The parts of one wall element 19 are welded to each other and form end surfaces 20 and 21 of the side wall 13. This is advantageous since the whole side wall 13 with the refrigerant feeding opening 17 and the refrigerant discharging opening 18 may be completely prefabricated as an evaporator device and may be then enclosed if desired to form a box-like container with curved walls as presented in this embodiment. The location of the openings 17 and 18 at the most possible distance from each other provides the optimal refrigerant flow within the hollow space 15 between the individual walls 22 and 23.

The hollow chamber 15 between the wall 22 and 23 is subdivided into a plurality of chambers 24 communicated with one another. These chambers are formed by means of connecting spots 25 which are regularly spaced from one another. The walls 22 and 23 are rigidly connected to each other at the spots 25, for example by spot welding or by roller steam welding provided at welding points 26.

A heating device 27 is arranged in the bath container for periodically heating the bath container, which device provides control of the working liquid temperatures at any given rate. The refrigeration system of the conventional type to which the evaporator of the foregoing type is connected is operating during this periodical heating. Only when relatively large cooling loads about 1000 ccal/h (4187 cjoule/h) occur in the refrigeration system the heating is switched off.

Figure 2:
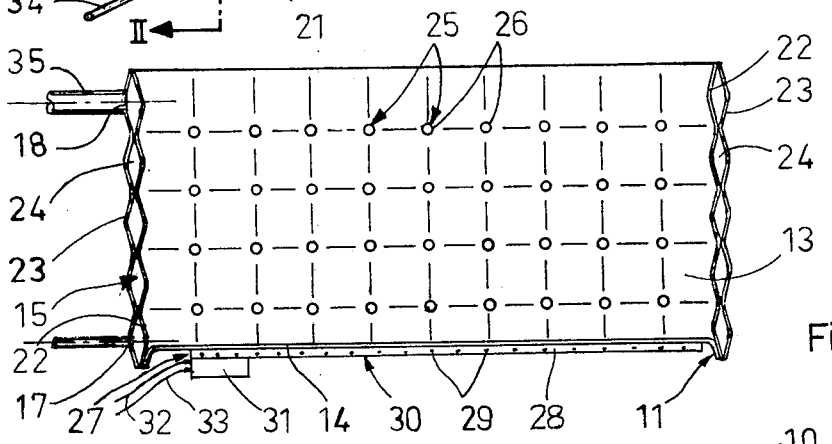
FIG. 2 is a sectional view taken along line II—II of FIG. 1.
Figure 3:
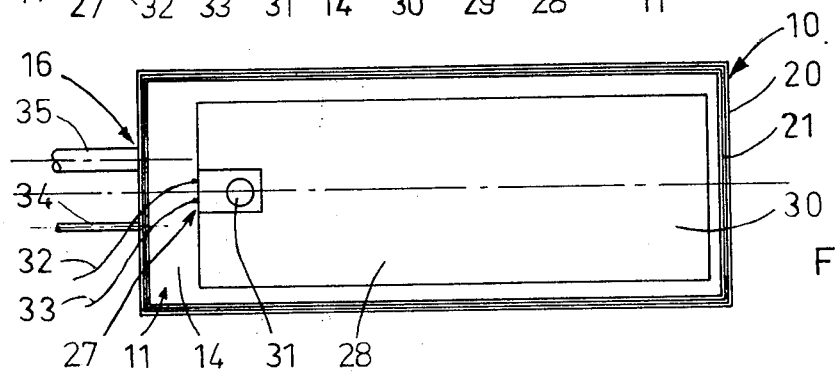
FIG. 3 is a bottom view of the bath container illustrated in FIG. 1.

The heating device 27 in accordance with the preferred embodiment includes a surface heating element 28 mounted on the outer side of the bottom wall 14. The heating element 28 is composed of a heating wire 29 of relatively small cross-section which is isolated from the wall 14 and is wrapped at least in portion, by thick packing into which the wire 25 is inserted. As may be clearly seen in FIG. 2, the heating wire 29 is embedded into a supporting mat 30 made of an insulating material. The mat 30 may be formed of silicone rubber and in this instance may be vulcanized with the housing 10. The heating wire 12 is connected to a protective switch 31 which in turn is connected with an external electrical circuit (not shown) by two cables 32 and 33.

As was mentioned hereinabove, the bath container is connected in the refrigerant circuit of the refrigeration system via the capillary tube 34 and the tubular conduit 35. It is to be understood that the capillary tube is communicated with the system condensor by commonly known tubular conduits whereas the conduit 35 is connected to the system compressor by feeding tubular conduits which are hermetically sealed in connection points, for example by means of welding or soldering. In this arrangement, the refrigerant circulates in the closed circuit whereby the evaporator 16 is formed in the interior of the refrigeration system.

In operation of the refrigeration system, the compressed fluid refrigerant will be injected into the hollow chamber 15 via the capillary tube 34 and opening 17. Due to expansion of the refrigerant the latter begins to evaporate in the hollow chamber 15. According to the invention the construction of the evaporator provides the available space of the predetermined size for the refrigerant so that the latter may be completely evaporated within this space, whereas in the well known tubular evaporators the amount of the refrigerator to be injected must be specially dosed. The refrigerant which was not immediately evaporated flows through the individual chambers 24 along the entire periphery of the side wall 13 and accumulated at the bottom of the side wall 13 within the space 15. The evaporator 16 is flooded by the refrigerant whereby the space 15 is filled with the fluid refrigerant and a vapor. As a result of this the working fluid contained in the bath container is cooled to very low temperature, which temperature is comparatively lower than the maximal cooling temperatures obtained in the conventional evaporators of the tubular type in the same types of refrigeration systems.

As was mentioned above the outlet opening 18 is located at such place on the side wall 13, that this opening is substantially spaced from the capillary tube 34 having an inlet opening 17. The velocity of the refrigerant within the chamber 15 is sufficiently small due to the size and length of the hollow chamber 15, which size and length are defined essentially by the periphery of the side wall 13 as well as by the size of the housing 10. Therefore, the hollow chamber 15 functions as a natural fluid separator where the fluid refrigerant is separated from the vapor at the bottom of the chamber 15. This is ensured by location of the tubular conduit 35 and capillary tube 34 at the most possible distance from one another which leads to the fact that only completely evaporated and dried refrigerant without addition of the fluid therein leaves the evaporator. The compressed fluid refrigerant will be also used in the evaporator as an internal cooling conductor to remove heat from the liquid contained in the bath. The surface size of the evaporator 16 extending along the entire periphery of the jacket 11 results in simultaneous heat removal from the working fluid through the substantially large surface area. This leads to fine temperature distribution with sufficient temperature constancy within the working fluid.

As may be easily understood from the above description, the evaporator 16 which is a part of the refrigeration circuit of the refrigeration system functions at the same time as a refrigerant accumulator in the contrary to the evaporators of the tubular types where refrigerant escapes to the refrigerant circuit. This fact leads to the substantial cost reduction in manufacturing of the refrigeration systems. The structure of the bath container in accordance with the invention with provision of capillary injection means for refrigerant makes conventional expansion valves in this structure superfluous, which expansion valves are indispensable in the refrigerant circuit between the condensor and evaporator of the tubular type in the conventional refrigeration systems. This, again may essentially reduce manufacturing costs of the refrigeration systems. At the same time the disadvantage reciding in the utilization of bolt connections in the connection points between the expansion valves and tubular coils in the refrigerant circuit of the known type is easily avoided in the present application. The tubular conduit 35 and capillary tube 34 are reliably sealed in the connection points with the conduits in the refrigerant circuit. In this case it is possible to remove the refrigerant from the refrigerant circuit if desirable to provide an absolute vacuum in the circuit. All above-discussed advantages of the present structure considerably encrease the longetivity of the whole refrigeration system.

The control of temperature maintained in the working fluid during the relatively large time rate is provided by means of temperature sensors which are for example, immersed into the working fluid or mounted outside of the fluid, for example on the surface of the housing wall 11 when the surface heating element 28 on the bottom wall 14 is periodically switched on. The electric current flowing through the heating wire 29 heats the working fluid via the entire surface of the bottom wall 14. The working fluid is thus heated by a surface contact with the heating device whereby sufficient temperature distribution through the working fluid is obtained. The special structure of the heating device 28 according to the invention ensures efficient heat exchange between the heating wire 29 and the working fluid. Relatively small thermal inercia masses which occur during the heat exchange process serve as an automatic retardation means in this process whereby extremely efficient control accuracy may be achieved. The surface heating element 28 provides sufficiently better accuracy even at 1/10 of usual heating loads comparatively with the known devices where heating coils are normally installed into the working fluid.

It has been also found advantageous that the surface heating element 28 according to the invention which provides a better control process in maintaining of the working fluid temperatures also serves for preventing accidents which may occur during operation of the refrigeration system. This is attained by the fact that the surface heating element 28 is installed into the arrangement not in immediate contact with the working fluid whereby the electric break down through the working fluid is avoided so that the danger of burning or explosion is totally excluded. In the known heating devices the heating coils inserted into the working fluid are usually utilized. In these devices the local overheating of the working fluid during the switching operations may occur so that the fluid is evaporated and the surface fluid will flow down within the interior of the bath container. This heating coil remains free eventually and the upper level of the working fluid in the bath may begin to glow. Usually, the working fluids to be cooled to low temperatures are burned when the fluid contacting the heating coil is inflamed. Such process can lead to a serious accident which is totally excluded by heating means, utilized in the evaporator of the invention.

It is therefore essential that the cooling equipment of the invention does not include such structural elements as heating coils or tubular conduits.

In the bath, container of the present invention the entire container volume is utilized and is completely available for the working fluid. The working process which occurs during cooling of the working fluid in the bath container is not affected by the internal structural elements of the device. The working fluid may be easily removed from the container for changing the fluid or for cleaning of the container.

It will be understood that each of the elements described above, or two or more together, may also find a useful application in other types of bath container differing from the types described above.

While the invention has been illustrated and described as embodied in a bath container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A bath container for cooling a liquid contained therein, particularly for use in refrigeration equipment, comprising a jacket bounding a space for the liquid and including a bottom wall and a peripheral side wall formed by two individual walls arranged to form an enclosed hollow chamber therebetween, said peripheral side wall being rigidly connected to said bottom wall and having an upper opening for receiving the liquid and being of a substantially rectangular cross-section to form four space boundary wall elements constituting said hollow chamber, said two individual walls being connected to each other by connecting spots uniformly spaced from each other to divide said hollow chamber into a plurality of chambers communicated with one another; one of said space boundary wall elements forming two end surfaces of said side wall; a capillary tube for injecting a refrigerant into said hollow chamber and located near one of said end surfaces; a refrigerant discharging member for withdrawing the refrigerant from said hollow and located chamber near another one of said end surfaces, said feeding member and said discharging member being spaced from one another at the most possible distance along the height of said jacket so that the refrigerant enters said capillary tube, passes through said hollow chamber and leaves the same through said refrigerant discharging member whereby said jacket functions as an evaporator; and a surface heating element mounted on said bottom wall and including a heating wire of a substantially small cross-section and being isolated from said bottom wall by an insulating mat rigidly connected to said bottom wall, said heating wire being embedded into said mat.

2. The container of claim 1, wherein said jacket is made of a stainless steel.

3. The container of claim 2, wherein said individual walls are rigidly connected to each other at said spots by means of spot welding.

4. The container of claim 2, wherein said individual walls are rigidly connected to each other at said spots by means of roller seam welding.

5. The container of claim 2, wherein said side wall is connected to said bottom wall by welding.

6. The container of claim 5, wherein said capillary tube and said refrigerant discharging member extend normal to one of said wall elements and connected to two opposite ends thereof, respectively.

7. The container of claim 6, wherein said side wall is a one-piece item.

8. The container of claim 6, wherein said wall elements are rigidly connected to each other to form said side wall.

9. The container of claim 8, wherein said wall elements are connected to each other by means of welding.

10. The container of claim 6, wherein said mat is made of silicone rubber.

11. The container of claim 10, wherein said mat is connected to said bottom wall by means of vulcanization.

* * * * *